US006786943B1

(12) United States Patent
Jaccard et al.

(10) Patent No.: US 6,786,943 B1
(45) Date of Patent: Sep. 7, 2004

(54) PROCESS AND APPARATUS FOR TREATING SOLID FUEL MATERIALS

(75) Inventors: Léon Jaccard, Curio (CH); Jean Patrick Jaccard, Curio (CH)

(73) Assignee: Greenpower Engineering & Technologies S.A., Curio (CH)

( * ) Notice: Subject to any disclaimer, the term of this patent is extended or adjusted under 35 U.S.C. 154(b) by 0 days.

(21) Appl. No.: 09/673,828

(22) PCT Filed: Jan. 5, 1999

(86) PCT No.: PCT/IB99/00001

§ 371 (c)(1),
(2), (4) Date: Jul. 6, 2000

(87) PCT Pub. No.: WO99/35214

PCT Pub. Date: Jul. 15, 1999

(30) Foreign Application Priority Data

Jan. 9, 1998 (CH) ..... 0035/98

(51) Int. Cl.[7] ..... C10J 3/02; C10J 3/26

(52) U.S. Cl. ..... 48/197 FM; 422/234

(58) Field of Search ..... 48/61, 62 R, 73, 48/77, 89, 99, 101, 111, 202, 209, 210, 197 FM; 422/188, 198, 203, 204, 234, 235

(56) References Cited

U.S. PATENT DOCUMENTS 3,841,851 A * 10/1974 Kaiser ..... 48/111

5,273,556 A * 12/1993 McMahon et al. ..... 48/197 R

FOREIGN PATENT DOCUMENTS

| | | |
|---|---|---|
| DE | 557 986 | 8/1932 |
| DE | 27 29 764 | 1/1979 |
| EP | 0 309 387 | 3/1989 |
| EP | 0 565 935 | 10/1993 |

* cited by examiner

*Primary Examiner*—Samuel M. Heinrich
(74) *Attorney, Agent, or Firm*—Harrison & Egbert

(57) ABSTRACT

Solid fuels, such as contaminated biomass and solid city waste, are converted into a synthesized gas by gasification and exploitation of the energy contained in the fuels. The fuel is gasified an a co-current gasogen (1), while the cinders are separated, removed and purified after a fraction of the fuels has undergone combustion and before the fuel has been gasified. Cinder purification is made by complete combustion, while the fuel that has undergone the gasification step without being completely transformed in CO is recirculated by mixing it to fresh fuel material. The process is carried out in an apparatus comprising a vertical co-current gasogen (1) and a device for the separation and removal of cinders (16,19,5,6) as well as a scorification chamber (3) where cinders are purified from accompanying fuel material by complete combustion and are then collected in a waste tank (28).

14 Claims, 1 Drawing Sheet

PROCESS AND APPARATUS FOR TREATING SOLID FUEL MATERIALS

Figure 1:
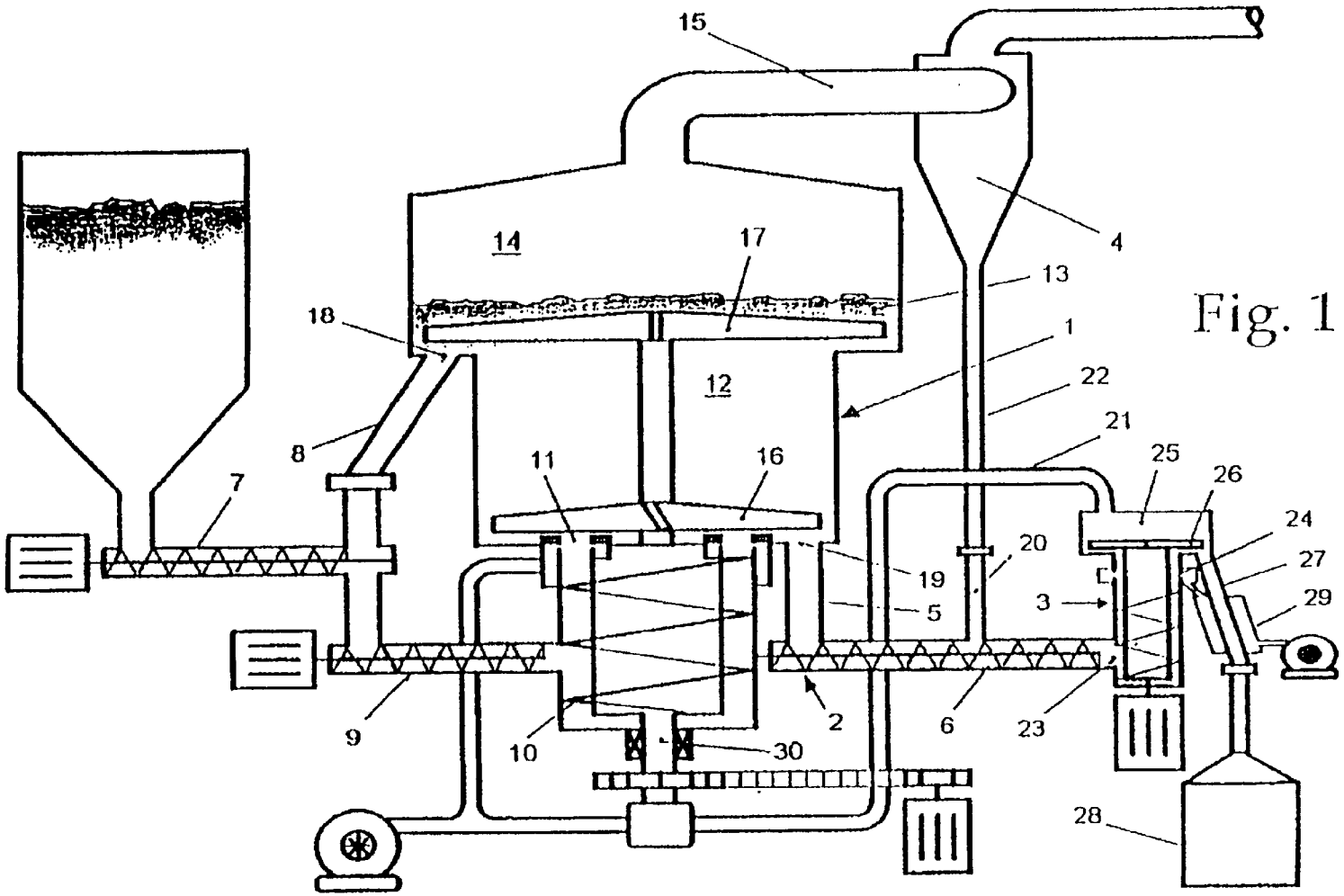

This invention is concerned with a process for treating solid fuels, such as contaminated biomass and solid city waste, and for converting them into a synthesized gas by gasification carried out in a co-current gasogen. The invention is also concerned with an apparatus for carrying out the process.

Several processes are known in the practice and the patent literature for treating solid fuel materials, and particularly contaminated biomass and solid city waste, by transformation of the fuel materials into a synthesized gas, from which energy is then retrieved in different ways, e.g. directly in form of heat energy, or indirectly by generation of electric power.

According to a process disclosed in detail, for instance, in EP-0 663 433, the fuel is first compacted in a tubular channel of preferably circular cross-section, then thermally treated by a process of gasification and pyrolysis, with generation of a synthesized gas in the tubular channel, and the carbonized material after the above heat treatment, is finally submitted to complete combustion at the end of the channel in a counter-current gasogen. In this known approach, cinders are separated only after complete combustion in the counter-current gasogen, due to the circumstance that the cinders are collected on the bottom of the gasogen, and then fall down onto a water bed acting as a sealing buffer to prevent gas exchanges between the gasogen and the outside environment.

The above known approach has two main disadvantages. On the one hand, it is very difficult to have a sufficiently large gasification chamber, such that the necessary gasification step can be completed, this step consisting in the transformation of $CO_2$, as developed in the partial combustion of a fraction of the material, into the CO synthesized gas, as is the object of the invention. As a matter of fact, the annular gasification chamber should, if its aim is to be attained, take an excessive length, with considerable, and possibly unsurmountable, constructive problems. On the other hand, cinders are separated and removed only after the complete combustion of the material in the counter-current gasogen has taken place, so that the cinders contaminate every step in the gasification process. It is apparent that it would be advantageous to separate the cinders from the fuel as soon as possible, so that the operating steps can be more easily governed or controlled.

According to another known solution for a co-current gasogen, as published in EP-0 565 935, a vertical co-current gasogen comprises a combustion area for a fraction of the material, having an annular shape, where the oxidant is fed from both the inner and/or outer sides, and a gasification chamber for the remaining material, which again is vertical and arranged above and downstream of the combustion area, in the direction of displacement of the material.

This approach does in fact afford optimal conditions of gasification, inasmuch as it allows gasification chambers of practically unlimited extension to be built, so as to insure complete transformation of the $CO_2$ generated into CO. Moreover, this solution also provides for recirculating the material that has undergone the gasification step without being completely converted into the synthesized gas. Such recirculation consists in allowing the above material to overflow laterally at the end of the gasification chamber and to drop laterally within the gasogen to mix with the fresh material at the bottom. However, this solution is not suitable for use in the gasification of solid fuel materials producing cinders during combustion, such as contaminated biomass and solid city waste, because it lacks a device for separating, removing and purifying the cinders, which will therefore remain in the gasogen and eventually clog it.

The object of the present invention is therefore to provide a process and an apparatus for treating fuel materials to convert them into a synthesized gas by gasification in a co-current gasogen, which can avoid the above drawbacks of the prior art and which can insure conditions of treatment of solid fuel materials, particularly contaminated biomass and solid city waste, giving rise to optimal cinders. In other words, the process should meet all rules in force concerning protection of air and water, and should be perfectly gorvernable and controllable, so that the apparatus can operate without interruption for long periods of time.

The above object is attained with a process for treating solid fuel materials, comprising a gasification step of the material in a co-current gasogen, according to the preamble of claim 1, having the features recited in the characterizing part of claim 1.

The invention also concerns an apparatus for carrying out the process according to the preamble of claim 10 and having the features recited the characterizing part of claim 10.

Dependent claims 2 to 9 concern preferred embodiments of the inventive process, and dependent claims 10 to 14 concern preferred embodiments of the apparatus for carrying out the inventive process, its advantages appearing more distinctly in the following disclosure of a preferred embodiment of the invention.

The invention will now be further described with reference to an example of the apparatus concerned, shown diagrammatically on FIG. 1.

GENERAL DESCRIPTION OF THE INVENTION

The invention comprises two main units:

- a vertical co-current gasogen 1, similar, in its main components, to the o gasogen disclosed in EP-0 565 935, to which is here made specific reference.
- a system 2 for separating and removing "cinders" arising within the gasogen, and an associated, though geometrically distinct, device 3 for purifying the cinders.

The term "cinders" is used to refer to all matter which is contained in the fuel supplied to the gasogen and which is incombustible and consequently not gasifiable. The mass percentage of cinders in the fuel can vary in a wide range: generally in the range 0 to 50%.

The cinders may originate directly from the removal carried out within gasogen 1, or they may be part of the dusts retained in the several purification modules for the synthesized gas (cyclone filters, cloth filters, electrostatic filters). The material with a high cinder content is conveyed, through a suitable duct, to purifying device 3, also called scorification chamber. In this chamber, the material is suitably treated so that only inert matter is obtained a final product A connection duct 5 leading from gasogen 1 to scarification chamber 3 is provided with a suitable material-conveying system 6, which, depending on the geometrical relationship between the two main units, may consist in a horizontal auger 6 as shown, or in an inclined auger, or in a simple inclined chute, possibly of the vibrating type.

The inventive gasogen is of the kind having a recirculating bed, the flows of gas and of solid matter being co-current and oriented vertically. The heat required by the process is supplied by the combustion of a predetermined fraction of the fuel supplied. The oxidant required for partial combustion may be, depending on circumstances, plain air, air enriched with oxygen, Or pure oxygen. In any case, particularly where air is used, the oxidant is pre-heated to a temperature above 400° C., by using a fraction of the available heat contained in the synthesized gas coming out from gasogen 1 at a high temperature (650 to 700° C.). Pre-heating allows the PCI of the gas to be increased, while improving combustion at the same time.

If necessary, in order to increase the synthesis of gas molecules with high hydrogen content ($H_2$ hydrocarbons), a mixture of oxidant and overheated steam may also be used.

The gasogen can operate either at atmospheric pressure or at higher pressures, in the range of a few tens of bars, so that the synthesis of hydrocarbons is promoted (particularly $CH_4$).

The fresh fuel material fed by auger 7 is mixed to the carbon resulting as a residue of gasification and emerging from duct 8, and is then propelled into the gasogen by injector auger 9. Within gasogen 1, a vertical auger 10 distributes the mixture uniformly over an extended, though narrow, annular surface, while, at the same time, lifting the mixture to the combustion area 11.

Until this time, the flows considered have only been submitted to physical operations. Chemical reactions start when the material reaches the immediate neighborhood of the annular combustion area 11. The oxidant atmosphere required for combustion is generated by blowing oxidant from the outside and from the inside of annular area 11. Combustion chamber 11 may be entirely built in a metal resistant to high temperatures, or it may have parts of ceramic or refractory material which will insure a long lifetime, particularly where pure oxygen is used as an oxidant in the process. Ceramic parts, or parts of a similar material, allow the process temperature to be increased, because they reduce the heat loss by conduction through metal walls. This helps the gasification process.

Under the action of high temperature, which is also favored by the physical concentration of the combustion, and of the oxidant atmosphere prevailing in that area, the material undergoes a number of chemical reactions, leading to the formation of gas and carbon (mainly pyrolytic and combustion reactions). The gas and carbon so generated move towards the top of gasification chamber 12, crossing carbon bed 13 located there. During their passage, the pyrolysis/combustion gas and the carbon react together chemically and physically until a final product is obtained which comprises the synthesized gas proper and the residual carbon that has not reacted. The synthesized gas emerges from carbon bed 13 and collects within rest chamber 14 (with the purpose of smoothing gas removal and of decanting a part of the suspended particulate) which in turn leads to gas outlet duct 15. The residual carbon is collected by gravity in duct 8 to undergo a fresh gasification cycle. A portion of the cinders contained in the fuel is removed through duct 5 and is processed separately in scorification chamber 3.

The central shaft in the gasification chamber, which is integral with the rotating vertical auger, is provided, at its bottom and top ends, with respective shovels 16 and 17, having the function of material distributors.

Lower shovels 16 are arranged turbine-like, i.e. with surfaces forming an angle to the vertical direction. As the shaft rotates, shovels 16 and 17 push the surrounding material upwards, and leave a small empty cavity on their lower sides along the entire shovel lengths. The empty cavity is invaded by the gas formed in the underlying combustion and pyrolysis, which, in the absence of any substantial resistance, will be distributed radially over the entire surface. Shovels 16 and 17 have thus the task of distributing the combustion-pyrolysis gas over the entire surface of chamber 12 and, since there is a relative motion between the shovels and the material, they also prevent the formation of preferential channels in the passage of the gas. As it will appear below, shovels 16 also have the function of helping separation between carbon and inert cinders, so that the amount of fuel material to be treated in scorification chamber 3 is reduced Upper shovels 17 are arranged horizontally and have merely the task of conveying the excess carbon toward recirculation port 18.

Definition of Flows within the Gasogen

During operation of the apparatus, a hierarchy of the rated flow rates of the several augers should at all times be maintained:

rated flowrate in vert, auger 10>rated flowrate in injector auger 9>flowrate=in supply auger 7

The flow rates through vertical auger 10 and injector auger 9 are merely nominal as vertical auger 10, for instance, will convey at any given time only what it receives from injector auger 9. In this case the flow rate through vertical auger 10 would be equal to the flow rate through injector auger 9. Similarly, injector auger 9 will convey at any given time the flow rate of supply auger 7 plus the flow rate of the recirculated carbon. The balance of the flow rates is achieved due to the variations of their efficiencies.

This hierarchy is imposed in order to prevent clogging between the several augers, which would have serious consequences for the mechanics and the operation of the apparatus.

An important peculiarity of the inventive gasogen is the recirculation of the carbon that has not reacted during gasification. The recirculation of a fraction of the carbon is already known from EP-0 565 935 mentioned above, but the recirculation there is distinguished from the present invention because of the substantial difference between the beds in the respective configurations.

The advantages of recirculation are several:

- The recirculating carbon (having a substantially homogeneous chemio-physical composition) mixes with the fresh fuel before entering the gasogen, thus improving the homogeneity of the physical and chemical characteristics of the material reaching the combustion area, and consequently stabilizing that area.
- The recirculating carbon reaching the combustion area, which is dry, hot and of a low grading, tends to burn before the fresh fuel with which it is mixed. This leads to a saving of a part of the pyrolized gas developing from the fuel, which would otherwise be burned in this oxygen-rich area.
- The carbon acts as a filter and catalist with respect to several substances, among which are tars. Since the bed recirculates, each passage through the combustion area regenerates the specific properties of the carbon, which would. otherwise be progressively lost.
- The gasification chamber holds a bed comprising mainly carbon and inert matter. Since the separation and removal device is unable to remove the totality of inert matter, the recirculation prevents it from accumulating within the bed and progressively reduce the amount of carbon that can react and consequently also the efficiency of the gasification reactions. Due to recirculation, inert matter is brought to the neighborhood of the cinder removal port 19, and its rate within the carbon bed is maintained constant.

The amount of recirculating carbon is regulated by adjusting the ratio between the flow rates through supply auger 7 and through injector auger 9. The larger the flow rate through injector auger 9 with respect to the flow rate through supply auger 7, the more carbon will be recirculated. Consequently, the material reaching the combustion area will have a higher rate of carbon and a lower rate of fresh fuel.

The power developed in the gasogen is regulated by adjusting the flow rate of injected fuel. An increase in the oxidant flow rate will give rise to an increase in the output power generated by the gasogen, and vice-versa for a reduction. It is obvious that to a power variation of the gasogen will correspond a variation of the flow rate of the fuel in the same direction; this will give rise, consequently, to a variation of flow rate in supply auger 7.

It should be noted that supply auger 7 is preferably not controlled by an operator directly, but rather it is governed by the level detector placed at the top of the carbon bed (not shown). This will provide to keep the carbon level at a height that is always slightly above the height of the recirculation port.

Scorification Chamber 3

The first step in the process of removal of inert matter or cinders contained in the fuel takes place within gasogen 1, and more particularly on the bottom of gasification chamber 12. Due to the relative motion between lower shovels 16 and the material, a sort of scrambling of the material is obtained. By taking advantage from the difference in density and size grading of carbon and cinders, the latter can be made to settle (or "decant") on the bottom of chamber 12. The rotary motion of shovels 16 then pushes the cinders toward the removal port 16, where they are then removed.

Gasogen 1 and gasification chamber 12 are two physically quite distinct devices. Communication between them takes place in form of material removed from gasogen 1 and conveyed to scorification chamber 3 and in the form of combustion gas generated in scarification chamber 3 and reintroduced to gasification chamber 12 of gasogen 1.

As already mentioned above, the transport of the material can take place through a horizontal or inclined auger 6, by chute along an inclined duct, or through any other transport device which is able to operate at a high temperature and which is able, at the same time, to insure a complete seal.

During the transfer from gasogen 1 to scorification chamber 3, connections are also preferably provided with other transport systems 20, which, for instance, convey dusts coming from the gas filtering device. It is thus possible to reduce solid emissions from gasogen 1 to the mere inert matter coming from scorification chamber 3.

Operation of the Scorification Chamber

The material reaching the scorification chamber 3 comprises a substantial fraction of inert material and a less substantial fraction of carbon, which is inevitably conveyed with the cinders.

The task of scarification chamber 3 is to purify the above heterogeneous mixture, so that its outlet delivers cinders only. This step raises the overall efficiency of the apparatus and avoids the loss of the chemical energy inherent to the carbon, which would otherwise be wasted Moreover, the amount of cinders produced in the gasogen is reduced to a minimum.

Cinder purification is achieved by blowing a metered amount of oxygen into scorification chamber 3 (in form of plain air, enriched air or pure oxygen), so that the carbon therein is completely burned. Oxygen may be derived off the primary air circuit of the gasogen, or it may be supplied by a fully independent air circuit. Gas produced by the combustion of the material comprising almost exclusively $CO_2$, a CO fraction and possibly $N_2$ (when using air as an oxidant), is, e.g., subsequently added, through pipe 21, to the oxidant used in the combustion of a fraction of the material so that it is partially reconverted to CO by exploiting the "purifying" properties of the carbon bed at the same time. In order to avoid disturbing the composition of the synthesized gas produced in gasogen 1, due, for instance, to the introduction of excessive and unnecessary amounts of oxygen and nitrogen, and in order to avoid removal of carbon-containing material from scorification chamber 3, the oxidant blown into the scorification chamber should be as far as possible in the required stoichiometric ratio.

The material comprising carbon and inert residue, emerging from gasogen 1 through pipe 8 and/or coming from the gas filtering device 4 through pipe 22, reaches scorification chamber 3 through auger 6. This material is then engaged by auger 23 (which has a rated capacity larger than auger 6) and conveyed to annular combustion area 24, where, due to air blowing to the outside periphery and to the high temperature, carbon combustion takes place. The combustion can proceed, if necessary, as far as distribution chamber 25. Combustion area 24 and distribution chamber 25 are preferably built in a metal resistant to high temperatures or in a ceramic or refractory material.

The combustion gas is extracted through pipe 21 for reintroduction into gasification chamber 12. The spent cinders, on the other hand, are engaged by shovels 26, which are integral with the upper end of auger 23, and are swept off through a chute 27 into a storage tank 28. It should be noted that the oxidant necessary for combustion in the scorification chamber 3 may be heated in heat exchanger 29, thus exploiting the heat contained in the hot cinders. This will cool the cinders, thus reducing the heating problems in the storage tank placed downstream and increasing the overall efficiency of the apparatus. Any sensors required for process control are placed at the inlet of chute 21 (not shown).

It should be noted that the material flow removed from the gasogen determines the percentage of cinders in the carbon bed: the larger the flow, the less cinders will be present in gasification chamber 12. On the other hand, the higher is the flow of removed material the more carbon is contained in it.

The simplest way to manage the operation of scarification chamber 3 is to set a fixed value for the material flow through auger 6 and an associated value for the oxidant flow, so that the stoichiometric ratio is approached. These values can be established by means of tests made on the apparatus during operation and then refined with operating practice.

A more accurate way of managing scarification chamber 3, which, however, requires suitable sensors, is to regulate the flow of oxidant blown in. If the stoichiometry of the combustion is to be satisfied, the oxidant flow rate corresponds to a given carbon flow rate. The material flow rate, which also contains cinders, is therefore determined as a function of the prescribed oxidant flow rate and of the carbon content in the material.

The stoichiometry of combustion can be evaluated mainly in two ways: analysis of the $O_2$ content in the combustion gas and/or analysis of the temperature of the combustion fumes. Through analysis of the presence of oxygen in the fumes, any shortage or excess of fuel can be determined, and consequently an insufficient or excessive flow rate through auger 6.

Management by analysis of the fume temperature requires preliminary tests made on the operating apparatus, in order to determine the temperature as a function of excesses or shortages in the flow rate of the waste material. After this determination has been made, a comparison of the real fume temperature with the table of experimental values will show which adjustments should be made to the auger flow rate.

In summary, the most important features in the present invention are as follows:

a) Concerning the gasogen proper.

A fraction of the carbon bed is recirculated.

The recirculating carbon is mixed to the fresh fuel before reaching combustion area 11.

Recirculation makes place outside the main gasogen structure.

The recirculation rate, as well as the material flow rate through combustion area 11 is managed by adjusting the flow rate of injector auger 9: vertical auger 10 has just to convey all the material received.

The power of the apparatus is adjusted by changing the primary oxidant flow rate. Fuel consumption is adjusted by controlling the flow rate in the supply auger.

Turbine-like shovels 16, integral with central shaft 30, homogeneously distribute the combustion gas over the entire surface of the bed, and avoid formation of preferential flow channels through the bed Shovels 16 also help inert matter contained in the fuel to settle on the bottom of the gasification chamber and push the inert matter toward the removal outlet 19.

Ceramic or similar parts are preferably installed in hot areas, in order to increase the process temperature, improve gasification and prolong the lifetime of such areas.

b) Concerning scarification chamber 3:

The scorification chamber 3 is physically distinct from gasogen 1, and communicates with it through cinders removal auger 6 and pipe 21, which blows the combustion gas in.

It can handle flows having a high cinders content, originating from gasogen 1 and from the gas-filtering device 4, by means of a number of connections such as 8, 22 leading into cinders removal duct 6.

It gives rise to a sold waste comprise only inert matter, with maximum reduction of its quantity and an improved overall efficiency of the apparatus.

It does not generate emissions, because the combustion fumes are added to the oxidant and are reintroduced into combustion chamber 11, where they have a further chance to participate in the specific chemical reactions a draw a benefit from the purifying properties of the carbon bed.

Combustion chambers 11 or 24 may be built in ceramic or in a similar material.

The inventive process and apparatus can be applied in the heating treatment of any organic matter, in the widest meaning of the word (including matter of natural origin as well as matter of chemical origin, such as the several hydrocarbons, plastics, rubber, etc.), even if they contain substantial amounts of inert, and therefore incombustible, matter (as high as 50%). The peculiar mechanical structure has the ability to treat fuels of different sizes and shapes. More particularly, the process and apparatus of the invention can use crumbled powders, briquettes, pellets, having a size or grading only limited by the mechanical conveying ability.

The resulting product is a so-called "weak" gas, having a chemical composition and a flow rate depending on the fuel used, and capable of being used to different purposes, such as direct combustion for beating air, water or other desired fluid, or in the production of overheated steam for operating a turbine, or for operating a gas turbine or an internal combustion engine. It could also be used as a starting material in the chemical industry (synthesis of ammonia, methanol etc.).

What is claimed is:

1. A process for treating solid fuel materials, such as contaminated biomass and solid city waste, and converting them into a synthesized gas, comprising: a fuel gasification step carried out in a co-current gasogen and in which a fraction of the fuel materials undergoes combustion with an oxidant and the heat developed in the combustion is exploited for gasifying the remaining material; and a cinders separation, extraction and purification step, wherein cinders are separated and removed from the fuel material after it has underdone the partial combustion and before it has been gasified;

cinders are then purified and collected after eliminating from it any remaining fuel material through complete combustion;

the fuel material which has undergone the gasification step without being fay converted to gas (CO) is recirculated by mixing it to fresh material before the latter is submitted to combustion.

2. The process for treating solid fuel materials according to claim 1, wherein the combustion gas, particularly $CO_2$, as developed during cinders purification, is mixed to the oxidant used for the combustion of a fraction of the fuel material.

3. The process for treating solid fuel materials according to claim 1, wherein the oxidant is heated to a temperature higher than 400° by means of a fraction of the available heat contained in the synthesized gas flowing at a high temperature from the gasogen, before conveying it to support the combustion of a fraction of the fuel material.

4. The process for treating solid fuel materials according to claim 1, wherein the oxidant includes a proportion of overheated steam.

5. The process for treating solid fuel materials according to claim 1, wherein the oxidant is fed to the gasogen under pressure.

6. The process for treating solid fuel materials according to claim 1, wherein plain air is used as an oxidant.

7. The process for treating solid fuel materials according to claim 1, wherein air enriched with oxygen is used as an oxidant.

8. The process for treating solid fuel materials according to claim 1, wherein pure oxygen is used as an oxidant.

9. The process for treating solid fuel materials according to claim 1, wherein filter dust recovered in filtering the synthesized gas is added to the cinders, after separation and removal and before purification, so that the filter dust undergoes the same purification process.

10. An apparatus for carrying out the process of claim 1, comprising a vertical, co-current gasogene (1) having an annular combustion area (11) for the combustion of a fraction of the fuel material where the oxidant is fed to both its inner and its outer sides, and a gasification chamber (12) for gasifying the remaining fuel material, the gasification chamber also being vertical and being located above and downstream of the combustion area (11) in the direction of fuel material displacement, wherein the floor of the gasification chamber (12) has a device (16, 19, 5, 6) for separating and removing cinders, comprising a port (19) feeding the cinders and the accompanying fuel material, through a feeding channel (6), to a scarification chamber (3), where the accompanying fuel material is completely burned and transformed into $CO_2$, while the cinders are collected, after purification, in a cinder tank a recirculation device (17, 18, 8), located at the top of the gasification chamber (12) for recirculating the material which has undergone the gasification step without being completely transformed into the synthesized gas (CO), comprises a rotating material distributor in form of shovels (17), the recirculation device conveying the recirculating material to an outlet aperture (18) leading into a pipe (8) which feeds the recirculating material to a duct (7) for the supply of fresh fuel material, where the fresh fuel material is mixed with the recirculating material before being introduced into the gasogen (1) as a fuel mixture.

11. The apparatus of claim 10, wherein the vertical co-current gasogen (1) comprises a rotating vertical auger (10) feeding the material upwards in the annular combustion area (11).

12. The apparatus of claim 10, wherein the recirculating device (17, 18, 8) feeds the recirculating fuel material to a feeding duct (7) for the fresh fuel material, which is provided with a first, substantially horizontal auger, where the fresh material is mixed with the recirculating material, and which in turn feeds the mixture of fresh fuel material and of recirculating material, as fuel, to the vertical auger (10) of the gasogen (1) through a second substantially horizontal auger (9) opening into the vertical shell of the vertical auger (10) of the gasogen (1).

13. The apparatus of claim 10, wherein the cinder separation and removal device (16, 19, 5, 6) comprises a distributor unit (16) for distributing, conveying and aerating the material which collects on the floor of the gasification chamber (12), the distributor unit comprising one or more horizontal shovels (16) which rotate around a vertical gasogen axis, the shovels being oblique to the floor plane, so that they sweep a radial chamber extending for the entire length of tie shovels (16) and having the function of smoothly distributing the combustion gas over the entire cross-section of the gasification chamber (12) whilst avoiding preferential gas flowing channels.

14. The apparatus of claim 10, wherein the scorification chamber (3) comprises a rotating vertical auger (23) which is supplied with cinders and with accompanying fuel material through a substantially horizontal auger (6) opening in the vertical shell of the auger (23) of the scorification chamber (3) and in that the purification of the cinders takes place by way of combustion of the accompanying fuel material in an annular combustion chamber (24) located in the upper portion of the auger (23) of the scarification chamber (3), and supplied with oxidant at least at one of the annular peripheries of the combustion chamber.

* * * * *